US006187142B1

(12) United States Patent
Heinzmann et al.

(10) Patent No.: US 6,187,142 B1
(45) Date of Patent: Feb. 13, 2001

(54) PROCESS AND DEVICE FOR ACTING ON A PAPER OR CARDBOARD WEB WITH ONE OF A FLUID AND PASTY COATING MEDIUM

(75) Inventors: Helmut Heinzmann, Böhmemkirch; Ingolf Cedra, Heidenheim; Peter Gallina, Herbrechtingen; Volker Schmidt-Rohr, Heidenheim, all of (DE); Michael Trefz, Appleton, WI (US)

(73) Assignee: Voith Sulzer Papiertechnik Patent GmbH, Heidenheim (DE)

( * ) Notice: Under 35 U.S.C. 154(b), the term of this patent shall be extended for 0 days.

(21) Appl. No.: 09/176,961

(22) Filed: Oct. 22, 1998

(30) Foreign Application Priority Data

| | | |
|---|---|---|
| Oct. 24, 1997 | (DE) | 197 47 091 |
| May 8, 1998 | (DE) | 198 20 586 |
| May 6, 1998 | (DE) | 297 23 289 U |
| May 27, 1998 | (DE) | 198 23 738 |

(51) Int. Cl.[7] ..... D21H 19/10; D21H 23/22

(52) U.S. Cl. ..... 162/135; 162/136; 162/265; 118/257; 118/313; 427/348

(58) Field of Search ..... 162/135, 136, 162/265, 358.1; 168/62, 63, 257, 264, 313; 427/348, 341, 342, 361

(56) References Cited

U.S. PATENT DOCUMENTS

| | | | | |
|---|---|---|---|---|
| 2,130,241 | * | 9/1938 | McLaurin | 91/68 |
| 5,152,872 | | 10/1992 | Racine et al. | 162/184 |
| 5,578,125 | | 11/1996 | Sieberth | 162/184 |
| 5,783,043 | * | 7/1998 | Christensen | 162/265 |
| 5,789,031 | * | 8/1998 | Hirabayashi et al. | 427/341 |

FOREIGN PATENT DOCUMENTS

| | | |
|---|---|---|
| 1942348 | 3/1971 | (DE) . |
| 3146828 | 6/1983 | (DE) . |
| 4340039 | 4/1994 | (DE) . |
| 29621877 | 3/1997 | (DE) . |
| 0815948 | 1/1998 | (EP) . |

* cited by examiner

*Primary Examiner*—Dean T. Nguyen
(74) *Attorney, Agent, or Firm*—Greenblum & Bernstein, P.L.C.

(57) ABSTRACT

Process and device for acting on one of a still-wet and moist material web with one of a fluid and pasty coating medium in the manufacturing process. The process includes producing the material web in a wet section of a web producing machine, applying, in at least one coating point, a coating medium to at least one surface of the material web while the material web is in the wet section, and applying at least one of steam and water in the region of the at least one coating point. The device includes at least one endless, water-permeable belt, at least one coating device being adapted for one of direct and indirect application of a fluid or pasty coating medium onto at least one side of a still-wet material web, and at least one applicator device, positioned in a region in which the coating medium contacts at least one of the material web and at least one belt, being adapted to condition the at least one of the material web and the at least one belt with at least one of steam and water.

42 Claims, 5 Drawing Sheets

PROCESS AND DEVICE FOR ACTING ON A PAPER OR CARDBOARD WEB WITH ONE OF A FLUID AND PASTY COATING MEDIUM

CROSS-REFERENCE TO RELATED APPLICATIONS

The present application claims priority under 35 U.S.C. § 119 of German Patent Application No. 198 23 738.3 filed May 27, 1998; German Utility Model Application No. 297 23 289.4 filed May 6, 1998; German Application No. 197 47 091.2 filed October 24, 1997 and German Patent Application No. 198 20 586.4 filed May 8, 1998, the disclosures of each of these documents is expressly incorporated by reference herein in their entireties.

BACKGROUND OF THE INVENTION

1. Field of the Invention

The present invention relates to a process for acting on a still-wet or moist material web, e.g., a paper or cardboard web, with one of a fluid and pasty coating medium in the manufacturing process, and a device for coating the still-wet or moist material web with one of the fluid and pasty coating medium in the manufacturing process.

2. Discussion of Background Information

Processes and devices similar in general to above-noted process and device are disclosed in U.S. Pat. No. 5,152,872. In this patent, a coating process and a coating device are disclosed for applying a fluid or pasty medium onto a still-wet paper web. The application of the coating medium is carried out directly onto the surface of the wet material web.

Another similar process and device have been disclosed in unexamined, published German Patent application DE-OS 1 942 348. In this document, a process and a device are disclosed for acting on a still-wet paper web with a coating medium. The coating medium is applied onto the web surface through a wire resting on the material web.

The two above-mentioned processes and devices suffer from the disadvantage that the surface of the coating medium may not be smooth and even, due to either wire soiling or insufficient uniformity in the application.

SUMMARY OF THE INVENTION

The present invention relates to a process and a device for acting on a still-wet material web, e.g., a paper or cardboard web, which does not suffer from the above- noted drawbacks of the prior art and that improves the uniformity of the application onto the web.

In accordance with the present invention, it is advantageous to treat a material web onto which a coating medium is to be delivered and/or a wire through which the coating medium is to be introduced onto the material web with water, and preferably steam, to condition these elements in a coating point region. In this manner, the uniformity of the application onto the traveling material web is improved.

Moreover, an increase in the application efficiency can be achieved. The application efficiency is a relationship between a quantity of coating medium that actually remains adhered to the material web after the coating process and a quantity of coating medium processed in the coating device. In the case of screen conditioning, a reduction of screen soiling, i.e., a reduction of the propensity for the screen to become soiled, is achieved. In this manner, an increase in the permeability of the screen is produced. Furthermore, because the screen heats up beforehand, it advantageously turns out that a temperature gradient between the coating medium (or application color) and the screen is reduced.

Another advantage is that, because of the additional cleaning of the screens, binder-rich coating mediums or application colors, e.g., a starch additive, may be used in the dual screen region of a web making machine.

If conditioning of the screen is carried out by heating the screen, then a local widening of the screen mesh may also occur, as well as a reduction in the viscosity of the coating medium. In this manner, an improved penetration of the screen and an evening-out of the coating are produced.

If conditioning of the screen is carried out after the application, i.e., when the screen is still resting on the web surface, then a reduction in the viscosity of the coating medium may be achieved and an increase in the drainage speed of the coating medium into the web occurs. Additionally, there is a flushing effect with respect to the screen. In this event, the paper or cardboard web partially absorbs the water.

If conditioning of the screen is carried out after the screen, through which the coating medium is applied to the material web, has been removed from the material web, then the conditioning increases the penetration speeds and improves cleaning. This is also the result of additional removal procedures. In any case, regardless of the point at which the conditioning of the screen is performed, an increase in the penetration speed of the coating medium through the screen is achieved. As a result of the improved penetration speed, the components retained in the screen, or the remainder of the coating medium, are reduced and a caking of the color coating medium onto the screen is prevented. Another advantage of conditioning the screen is that, due to the improved application efficiency, a reduction of the water loading via the coating medium is achieved through the screen cleaning.

In the exemplary embodiments of the process of the present invention, it may be advantageous if treatment of the material web, e.g., with steam or water, occurs directly before or after the coating point.

Further, it can be advantageous to perform conditioning on both sides of the material web or on screens positioned on both sides of the material web. Another advantageous embodiment includes a suctioning of excess fluid or impurities during or after conditioning. This can occur, for example, because a suction box may be attached opposite the applicator or because the conditioning of the screen or material web occurs on a suction roll.

Another advantageous embodiment of the process includes mixing steam or water with washing-active additives, such as tensides (surfactants), release agents, chemical barriers, or similar agents. For example, a pigment-free or pigment- containing slurry, or application color can be used as a possible coating medium. Further, kaolin, clay, calcium carbonate, zeolite, bentonite, $TiO_2$, or the like can be used as fillers of the coating medium. Starch, latex, surface sizing agents are examples of suitable binders. Retention agents, optical brighteners, or other additives for improving printability can be used as chemical additives. Anti-sticking agents can also be used. It is noted that the above list is exemplary and should not be construed as conclusive, and that all coating mediums known from paper coating can be used and combinations of the above-mentioned agents can be used or can be used in succession.

The above-described wet or moist material web may be, e.g., a paper or cardboard web that has a solids content of approximately 3–60% by weight, preferably approximately 3–23% by weight, and most preferably approximately 3–17% by weight.

An advantageous reaction time of the water or the steam for conditioning the material web and/or the screen may be preferably between approximately 0.1 and 10 milliseconds, and maximally up to approximately 15 milliseconds. The coating Weight, preferably after oven-drying, per side lies between approximately I and 15 g/m$^2$.

An advantageous water or steam quantity that is supplied to the screen lies in the region of the free screen volume, i.e., which corresponds to the interstices in the screen.

The above-mentioned process of the present invention, which has been described with respect to conditioning screens, may be likewise used to condition felts of the press section of the material web making machine.

According to the process of the present invention, a wet section of a paper or cardboard machine includes a wire section and a press section, each section having at least one endless, water-permeable belt, and at least one coating device for either direct or indirect application of a fluid or pasty coating medium onto at least one side of a still-wet paper or cardboard web is improved in the region in which the material web and/or belt come into contact with the coating medium. An applicator device is provided for acting on the at least one belt and/or the material web with steam and/or water. The advantages obtained by using the applicator device in the wet section have been described above.

In a particular embodiment of the wet section of the present invention, the applicator can be positioned directly above the web surface without an interposed screen or felt so that the applicator acts directly upon the surface of the material web. In this manner, further liquefaction of the coating medium may be achieved, whereby a flowing of a previously existing unevennesses may be evened-out of the coating.

Accordingly, the present invention is directed to a process for acting on one of a still-wet and moist material web with one of a fluid and pasty coating medium in the manufacturing process. The process includes producing the material web in a wet section of a web producing machine, applying, in at least one coating point, a coating medium to at least one Surface of the material web while the material web is in the wet section, and applying at least one of steam and water in the region of the at least one coating point.

In accordance with another feature of the present invention, the application of the at least one of steam and water in the region of the at least one coating point conditions the material web.

In accordance with another feature of the present invention, the coating medium is applied onto the at least one surface of the material web through at least one water-permeable belt. Further, the application of the at least one of steam and water in the region of the at least one coating point conditions the at least one belt.

In accordance with still another feature of the present invention, the application of the at least one of steam and water in the region of the at least one coating point occurs at least one of immediately before and after the coating point.

In accordance with a further feature of the present invention, the application of the at least one of steam and water in the region of the at least one coating point conditions one of both sides of the material web and belts positioned on both sides of the material web.

In accordance with still another feature of the present invention, the process further including suctioning at least one of impurities and excess fluid from the material web at least one of during and after the application of the at least one of steam and water in the region of the at least one coating point.

In accordance with another feature of the present invention, the process further including supplementing the at least one of steam and water with surface-active additives.

In accordance with a further feature of the present invention, the at least one coating point is located in a region of a suction roll.

In accordance with a still further feature of the present invention, the application of the at least one of steam and water in the region of the at least one coating point occurs in a region of a dual screen zone.

In accordance with a further feature of the present invention, an oven dried coating weight of the coating medium is preferably between approximately 1 and 15 g/m$^2$ per side.

The present invention is also directed to a wet section of a material web producing machine that includes at least one endless, water-permeable belt, at least one coating device being adapted for one of direct and indirect application of a fluid or pasty coating medium onto at least one side of a still-wet material web, and at least one applicator device, positioned in a region in which the coating medium contacts at least one of the material web and at least one belt, being adapted to condition the at least one of the material web and the at least one belt with at least one of steam and water.

In accordance with another feature of the present invention, the at least one applicator device is positioned directly above a surface of the material web and being adapted to directly condition the surface.

In accordance with still another feature of the present invention, the at least one belt is positioned between at least one coating device and the material web so that the coating medium is applied to the material web through the at least one belt. The at least one applicator device is adapted to condition the at least one belt, through which the coating medium is applied onto the material web. Further, the belt is separated from the material web prior to being conditioned by the at least one applicator device.

In accordance with a further feature of the present invention, the at least one belt including a dual screen, and the at least one applicator device is positioned adjacent the dual screen downstream of the at least one coating device with respect to a run direction of the dual screen.

In accordance with a still further feature of the present invention, the at least one belt including a dual screen, and the at least one applicator device is positioned adjacent the dual screen immediately upstream of the at least one coating device with respect to a run direction of the dual screen.

In accordance with another feature of the present invention, a suction device is positioned opposite the at least one applicator device.

In accordance with still another feature of the present invention, a suction roll is provided so that the at least one belt and the material web is guided over at least a portion of the suction roll. The at least one applicator is positioned in a vicinity of a suction region of the suction roll.

The present invention is also directed to a process for coating a moist material web in a wet section of a web production machine. The process includes guiding the moist material web and at least one screen through a coating point, coating at least one surface of the moist material web at the coating point with a coating medium, and conditioning at least one of the moist material web and the at least one screen with at least one of steam and water in a vicinity of the coating point.

In accordance with another feature of the present invention, the condition occurs prior to entering the coating point. The process further includes conditioning one of the at least one coated surface of the material web and the at least one screen with at least one of steam and water after the coating point.

In accordance with still another feature of the present invention, the process includes guiding the moist material web and the at least one screen over a suction roll having a suction region. The coating point may be positioned prior to the suction roll. Further, the coating point may be positioned between approximately 0 and 200 cm from an entrance to the suction region, preferably between approximately 2 and 100 cm from the entrance to the suction region, and most preferably between approximately 5 and 50 cm from the entrance to the suction region. Further still, the process further includes guiding the at least one screen to be lifted off the suction roll, conditioning the at least one screen with at least one of steam and water after the at least one screen has been lifted off the suction roll, and suctioning the at least one screen at a position opposite the conditioning after the at least one screen has been lifted off the suction roll.

In accordance with yet another feature of the present invention, the process includes separating the at least one screen from the material web after the coating point. Further, the process includes directly conditioning the material web with at least one of steam and water after separation of the at least one screen from the material web. The process also includes cleaning the at least one screen with at least one of steam and water after separation of the at least one screen from the material web.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
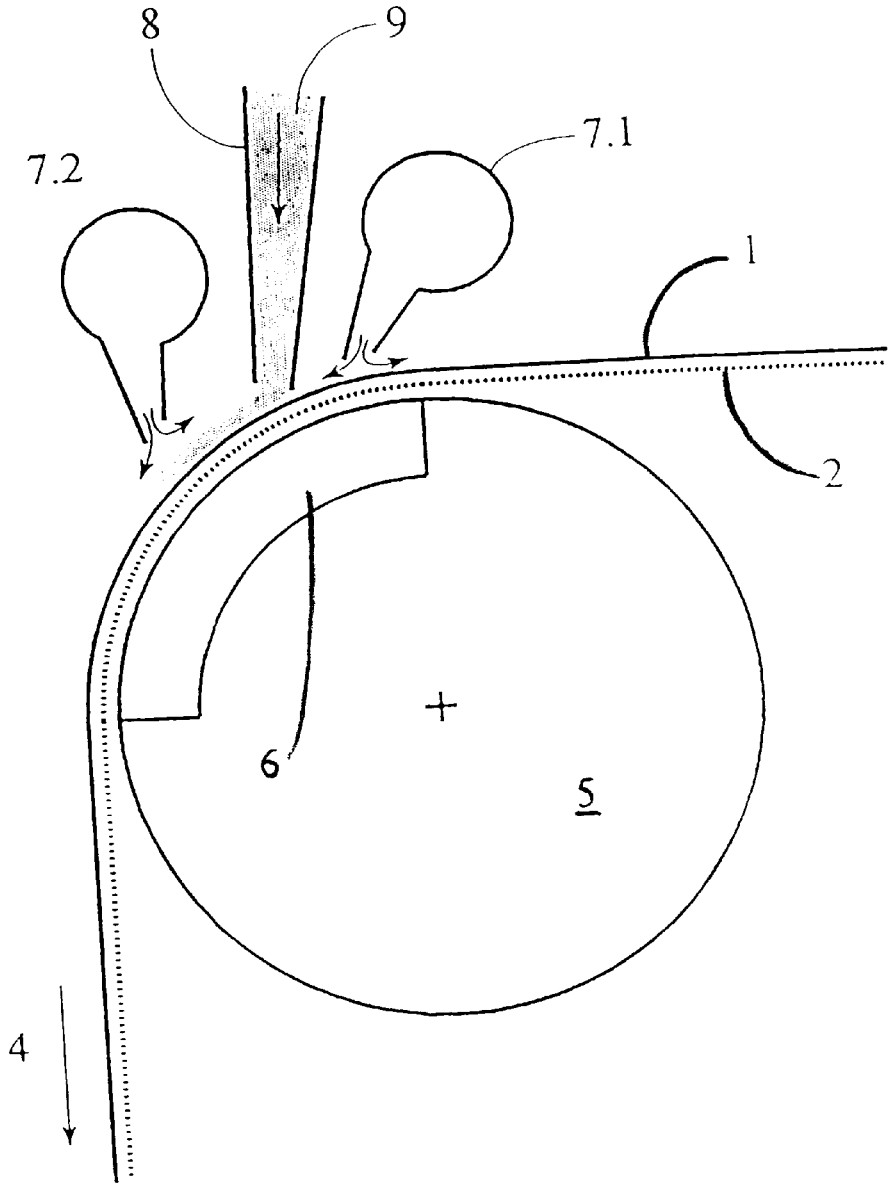
FIG. 1 illustrates a screen Suction roll with a material web and two applicators.

FIG. 1 illustrates a material web 1, e.g., a paper or cardboard web, that rests on or is guided by a screen (or an at least water permeable belt or felt) 2. Moving in a travel direction indicated by arrow 4, i.e., from the right, material web 1 and screen 2 are guided over a suction roll 5. Suction roll 5 includes a suction region or zone 6 that is located in a winding region of screen 2 and material web 1 around suction roll 5. A coating device 8 may be positioned opposite suction region 6 to apply a coating medium 9 to an exposed surface of material web 1. The point at which coating medium 9 is applied to material web 1 is referred to as the coating point. According to the present invention, directly before the coating point on material web 1, a first applicator 7.1 is positioned to condition material web 1 with water, e.g., in the form of steam. Likewise, a second applicator 7.2 is positioned directly after the coating point to provide a post-treatment of the coated material web 1, e.g., with at least one of water and steam. Thus, a first conditioning of material web 1 by first applicator 7.1 may be provided to facilitate improved adhesion and a more uniform application of coating medium 9 onto material web 1. In this regard, the various, supplementary agents, which have been noted above, can also be added to the water. The conditioning of material web 1 with second applicator 7.2 encourages coating medium 9 to flow on or over material web 1 so as to even-out of the coating over the entire width of material web 1. In this exemplary embodiment, coating device 8 is only depicted only schematically, and the specific coating device utilized in accordance with the features of the present invention can be any coating device, e.g., a doctor, a spray device, a flooded nip application, or other similar type devices, such as those devices known to those in the art.

Figure 2:
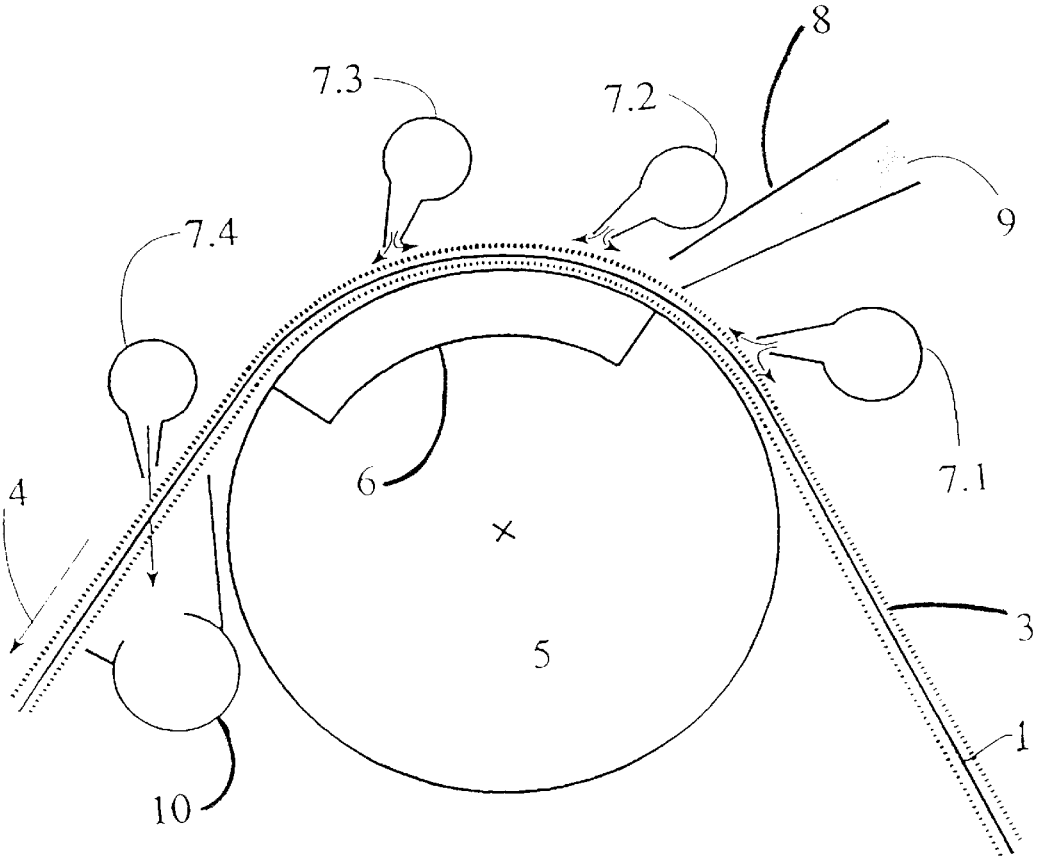
FIG. 2 illustrates a screen suction roll with a dual screen and four applicators.

FIG. 2, in accordance with the present invention, illustrates a dual screen (or sieve) device with an interposed material web 1 being conditioned in a region of a suction roll. Further, elements similar in general with those discussed above with regard to FIG. 1 have the same reference numeral in this figure. Dual screens 3 with interposed material web 1 is conveyed or guided in travel direction 4 over and around a partial section of suction roll 5. Shortly after dual screen 3 comes to rest against or contacts suction roll 5, i.e., in a region prior to suction zone 6, the outer screen of the dual screen 3, i.e., away from suction roll 5, is conditioned by first applicator 7.1. Coating device 8 is positioned after this contact point to apply coating medium 9 through the outer screen onto material web I sandwiched between dual screens 3. The permeability of the outer screen is facilitated by first applicator 7.1. Second applicator 7.2 is positioned adjacent to coating device 8, i.e., in travel direction 4 and within suction region 6 of suction roll 5. As a result of the conditioning of the outer screen, second applicator 7.2 provides improved penetration of coating medium 9 through the outer screen and, therefore, provides for an improved coating on material web 1. In this exemplary embodiment, a third applicator 7.3, for applying at least one of water and steam, may be positioned within suction zone 6 in order to extend the reaction time of the conditioning with dual screens 3. Further, the individual applicators may be augmented with various additives in the steam or water. After dual screens 3 are lifted up from or off suction roll 5, dual screens 3 may be guided to fourth applicator 7.4 that performs another, additional conditioning of dual screen 3. Fourth applicator 7.4, for applying at least one of water and steam, is supported by a suction device 10 positioned on the opposite side of dual screen 3 that suctions possible excess water and/or provides drainage for material web 1.

Figure 3:
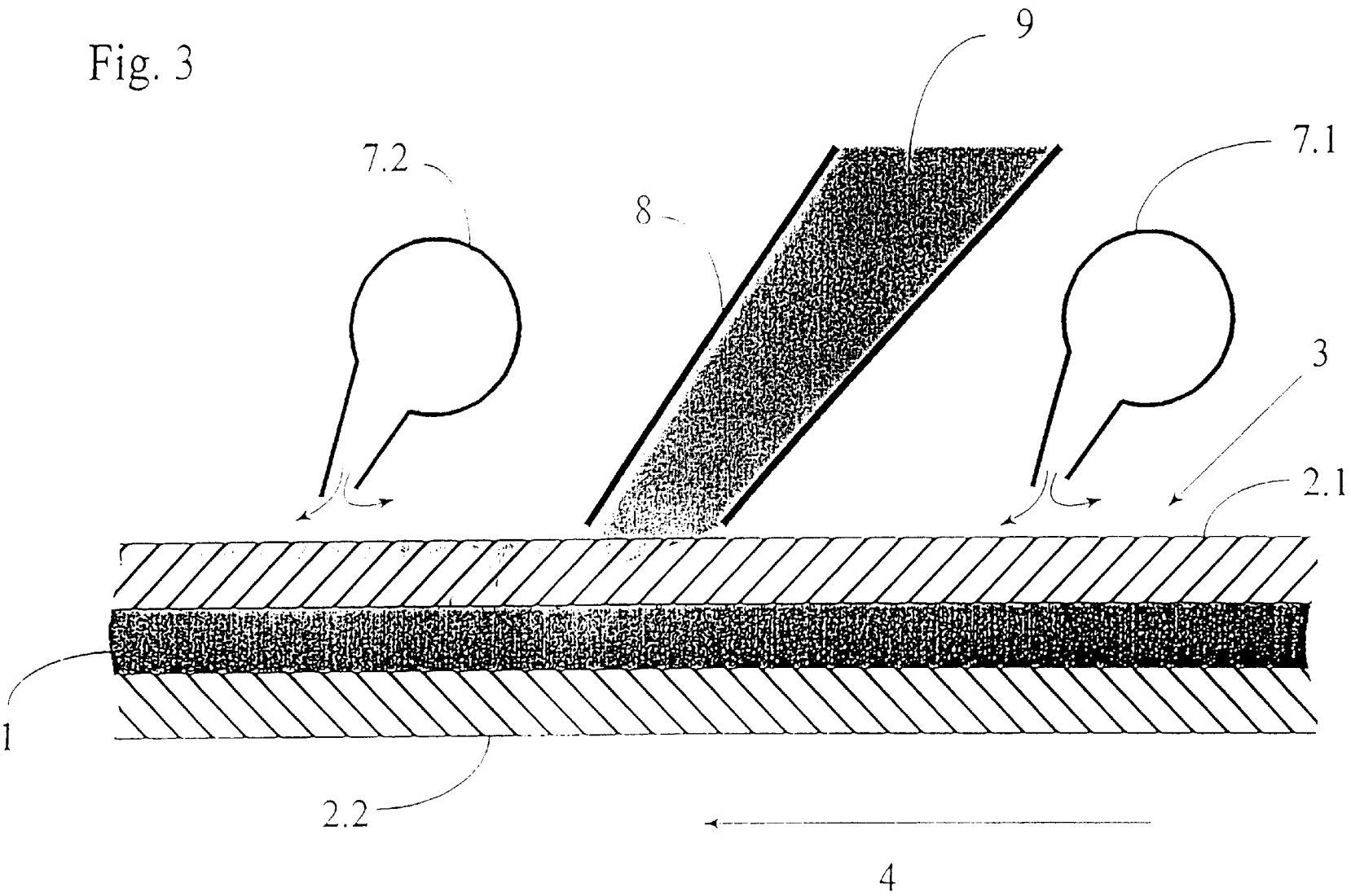
FIG. 3 illustrates a material web between a dual screen with two applicators.

FIG. 3 schematically depicts the coating point of dual screen 3 shown in FIG. 2. Dual screen 3 is composed of a top screen 2.1 and a bottom screen 2.2. Material web 1, which is sandwiched between top screen 2.1 and bottom screen 2.2, may be guided past coating device 8 in travel direction 4. First applicator 7.1 is positioned to condition top screen 2.1 before it reaches the coating point, which permits improved penetration of coating medium 9 that is applied to screen 2.1 by coating device 8. Second applicator 7.2 is positioned adjacent to, and downstream of, the coating point to further condition top screen 2.1. At this point, top screen 2.1 is saturated with coating medium 9, and second applicator 7.2 improves penetration of coating medium 9 through top screen 2.1 onto material web 1. In this manner, an evening-out of the coating is provided and an improved penetration through the screen occurs to improve the coating efficiency.

Figure 4:
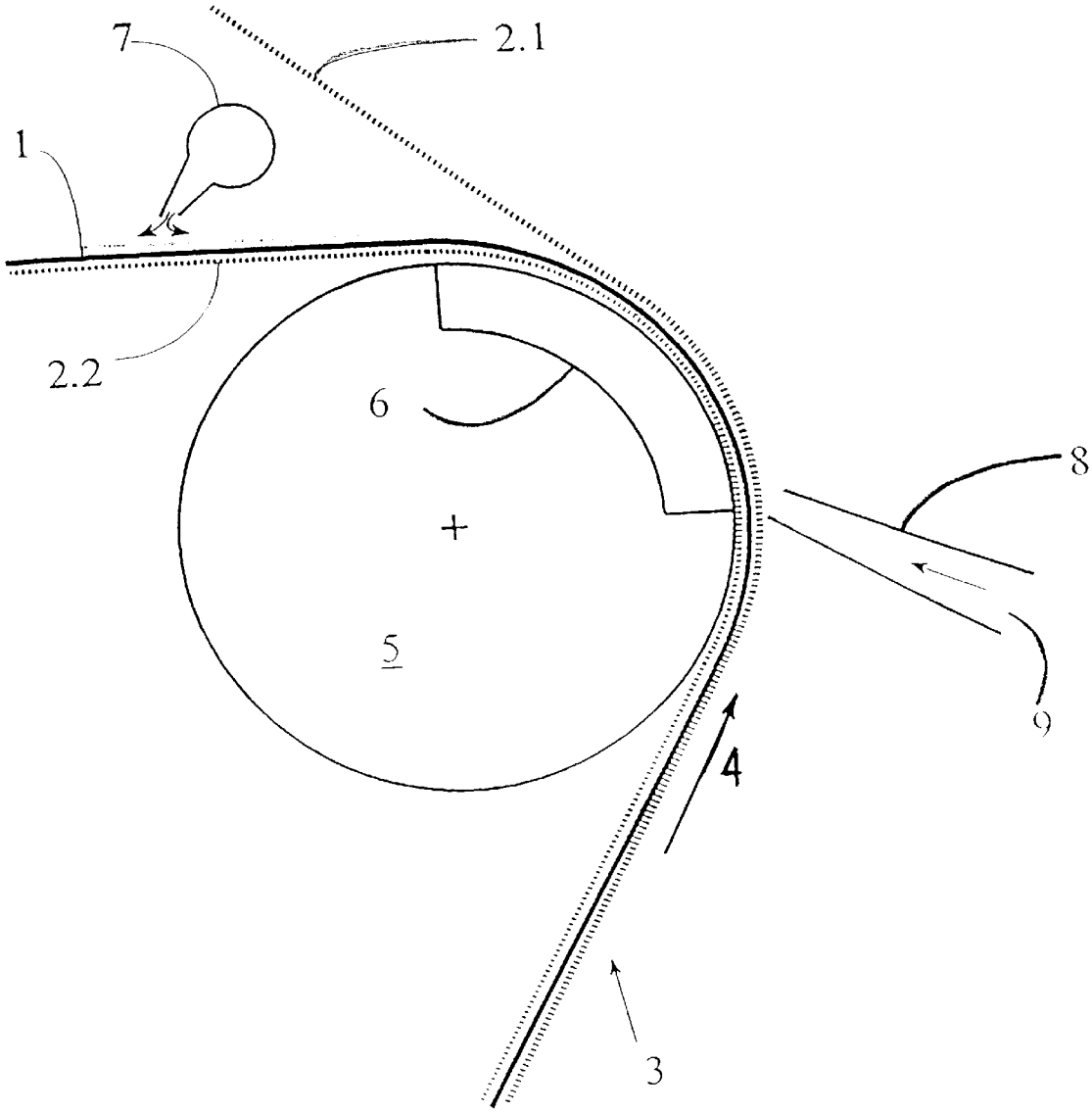
FIG. 4 illustrates a screen suction roll with a material web and two applicators.

In another exemplary embodiment for conditioning material web 1, FIG. 4 illustrates a dual screen 3 in which material web 1 is positioned between top screen 2.1 and bottom screen 2.2 that is guided over suction roll 5. Within suction region 6 of suction roll 5, dual screen 3 is acted on with coating medium 9 from coating device 8. Within the region of Suction zone 6, and downstream of coating device 8, top screen 2.1 is lifted up from or off material web 1 to expose the coated surface of material web 1 to be directly conditioned by an applicator 7. Without an interposed screen between applicator 7 and material web 1, an evening-out of the applied layer of coating medium 9 is achieved.

Figure 5:
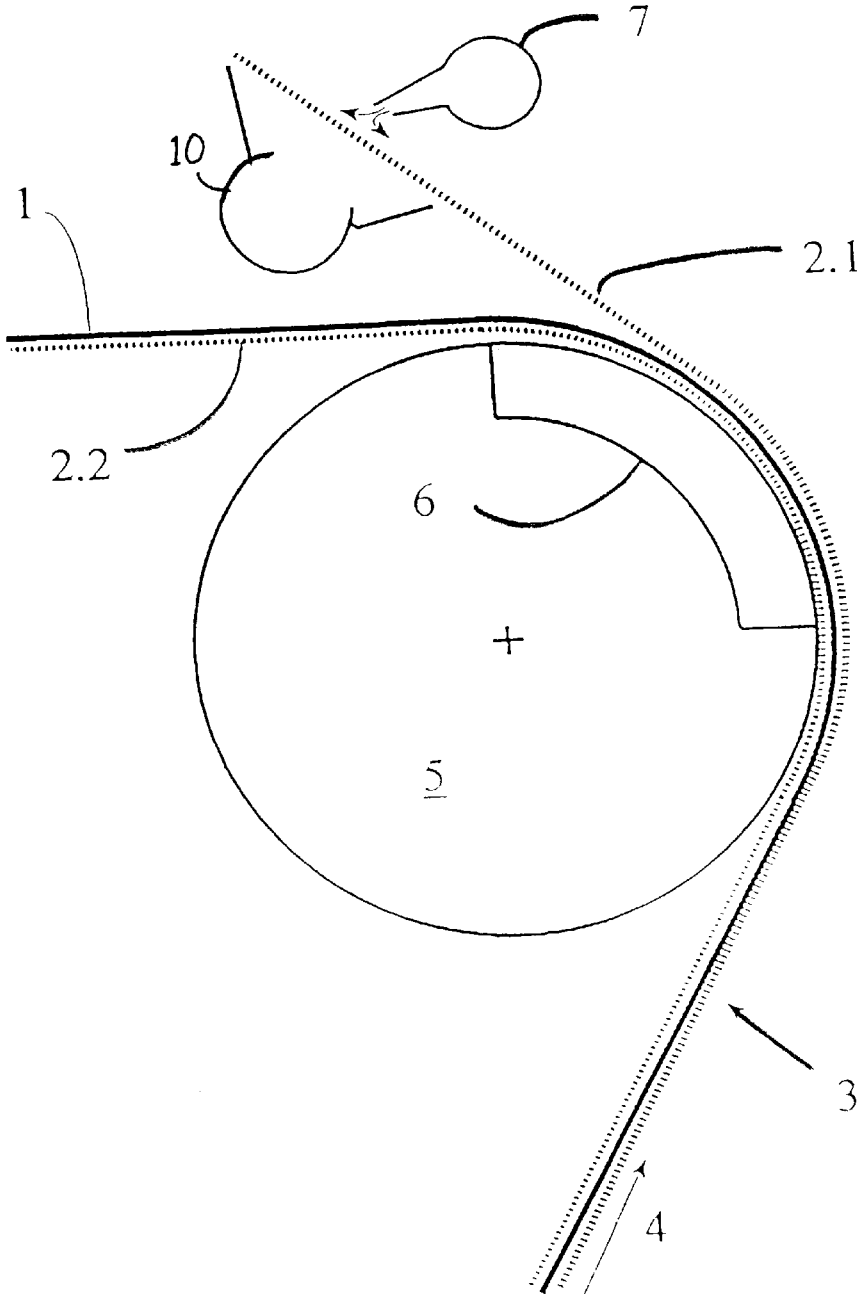
FIG. 5 illustrates a screen suction roll with a dual screen and an applicator after lifting the top screen.

FIG. 5 illustrates a dual screen 3 that is guided over suction roll 5. Within suction region 6, top screen 2.1 is lifted up from material web 1. A free draw of a raised or deflected portion of top screen 2.1 from suction region 6 is guided between applicator 7 and suction device 10. In this manner, screen 2.1 may be conditioned with water, e.g., in the form of steam, from applicator 7 that concurrently cleans and blows clear the pores of screen 2.1, which were previously coated with coating medium 9 (not shown).

In an alternative to the above-noted exemplary embodiments, the coating point may be positioned prior to the suction region. For example, the coating point may be positioned between approximately 0 and 200 cm from an entrance to the suction region, preferably between approximately 2 and 100 cm from the entrance to the suction region, and most preferably between approximately 5 and 50 cm from the entrance to the suction region.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

Reference Numeral List

1 material web
2 screen
2.1 top screen
2.2 bottom screen
3 dual screen with material web
4 travel direction
5 suction roll
6 suction region
7 applicator
7.1 first applicator
7.2 second applicator
7.3 third applicator
7.4 fourth applicator
8 coating device
9 coating medium
10 suction device

What is claimed:

1. A process for acting on one of a still-wet and moist material web with one of a fluid and pasty coating medium in the manufacturing process, the process comprising:

producing the material web in a wet section of a web producing machine;

applying, at at least one coating point, a coating medium to at least one surface of the material web while the material web is in the wet section; and applying at least one of steam and water in the region of the at least one coating point.

2. The process according to claim 1, wherein the application of the at least one of steam and water in the region of the at least one coating point conditions the material web.

3. The process according to claim 1, wherein the coating medium is applied onto the at least one surface of the material web through at least one water-permeable belt.

4. The process according to claim 3, wherein the application of the at least one of steam and water in the region of the at least one coating point conditions the at least one belt.

5. The process according to claim 1, wherein the application of the at least one of steam and water in the region of the at least one coating point occurs at least one of immediately before and after the coating point.

6. The process according to claim 1, wherein the application of the at least one of steam and water in the region of the at least one coating point conditions one of both sides of the material web and belts positioned on both sides of the material web.

7. The process according to claim 1, further comprising suctioning at least one of impurities and excess fluid from the material web at least one of during and after the application of the at least one of steam and water in the region of the at least one coating point.

8. The process according to claim 1, further comprising supplementing the at least one of steam and water with surface-active additives.

9. The process according to claim 1, wherein the at least one coating point is located in a region of a suction roll.

10. The process according to claim 1, wherein the application of the at least one of steam and water in the region of the at least one coating point occurs in a region of a dual screen zone.

11. The process according to claim 1, wherein a solids content of the material web at the time of the application of the coating medium is between approximately 3 and 60% by weight.

12. The process according to claim 1, wherein a solids content of the material web at the time of the application of the coating medium is between approximately 3 and 23% by weight.

13. The process according to claim 1, wherein a solids content of the material web at the time of the application of the coating medium is between approximately 3 and 17% by weight.

14. The process according to claim 1, wherein a reaction time of the at least one of water and steam with one of the material web or a screen positioned over the at least one surface of the material web to be coated is between approximately 0.1 and 10 milliseconds.

15. The process according to claim 1, wherein a reaction time of the at least one of water and steam with one of the material web or a screen positioned over the at least one surface of the material web to be coated is no greater than approximately 15 milliseconds.

16. The process according to claim 1, wherein an oven dried coating weight of the coating medium is between approximately 1 and 15 $g/m^2$ per side.

17. The process according to claim 1, wherein the material web comprising one of a paper and a cardboard web.

18. The process according to claim 1, wherein the wet section of the web producing machine includes a screen section and a press section.

19. A process for coating a moist material web in a wet section of a web production machine comprising:

guiding the moist material web and at least one screen through a coating point;

coating at least one surface of the moist material web at the coating point with a coating medium; and conditioning at least one of the moist material web and the at least one screen with at least one of steam and water in a vicinity of the coating point.

20. The process according to claim 19, wherein the condition occurs prior to entering the coating point.

21. The process according to claim 20, further comprising:

conditioning one of the at least one coated surface of the material web and the at least one screen with at least one of steam and water after the coating point.

22. The process according to claim 19, further comprising:

guiding the moist material web and the at least one screen over a suction roll having a suction region; and positioning the coating point prior to the suction region.

23. The process according to claim 22, wherein the coating point is positioned between approximately 0 and 200 cm from an entrance to the suction region.

24. The process according to claim 23, wherein the coating point is positioned between approximately 2 and 100 cm from the entrance to the suction region.

25. The process according to claim 23, wherein the coating point is positioned between approximately 5 and 50 cm from the entrance to the suction region.

26. The process according to claim 22, further comprising:

guiding the at least one screen to be lifted off the suction roll;

conditioning the at least one screen with at least one of steam and water after the at least one screen has been lifted off the suction roll; and suctioning the at least one screen at a position opposite the conditioning after the at least one screen has been lifted off the suction roll.

27. The process according to claim 19, further comprising:

separating the at least one screen from the material web after the coating point.

28. A process for coating a moist material web in a wet section of a web production machine comprising:

guiding the moist material web and at least one screen through a coating point;

coating at least one surface of the moist material web at the coating point with a coating medium;

conditioning at least one of the moist material web and the at least one screen with at least one of steam and water in a vicinity of the coating point;

separating the at least one screen from the material web after the coating point; and directly conditioning the material web with at least one of steam and water after separation of the at least one screen from the material web.

29. A process for coating a moist material web in a wet section of a web production machine comprising:

guiding the moist material web and at least one screen through a coating point;

coating at least one surface of the moist material web at the coating point with a coating medium;

conditioning at least one of the moist material web and the at least one screen with at least one of steam and water in a vicinity of the coating point;

separating the at least one screen from the material web after the coating point; and cleaning the at least one screen with at least one of steam and water after separation of the at least one screen from the material web.

30. A wet section of a material web producing machine comprising:

at least one endless, water-permeable belt;

at least one coating device being adapted for one of direct and indirect application of one of a fluid and pasty coating medium onto at least one side of a still-wet material web; and at least one applicator device, positioned in a region in which the coating medium contacts at least one of the material web and at least one belt, being adapted to condition the at least one of the material web and the at least one belt with at least one of steam and water.

31. The wet section according to claim 30, the at least one applicator device being positioned directly above a surface of the material web and being adapted to directly condition the surface.

32. The wet section according to claim 30, the at least one belt being positioned between at least one coating device and the material web so that the coating medium is applied to the material web through the at least one belt; and the at least one applicator device being adapted to condition the at least one belt, through which the coating medium is applied onto the material web.

33. The wet section according to claim 32, wherein the belt is separated from the material web prior to being conditioned by the at least one applicator device.

34. The wet section according to claim 30, the at least one belt comprising a dual screen; and the at least one applicator device being positioned adjacent the dual screen downstream of the at least one coating device with respect to a run direction of the dual screen.

35. The wet section according to claim 30, the at least one belt comprising a dual screen; and the at least one applicator device being positioned adjacent the dual screen immediately upstream of the at least one coating device with respect to a run direction of the dual screen.

36. The wet section according to claim 30, further comprising a suction device positioned opposite the at least one applicator device.

37. The wet section according to claim 30, further comprising a suction roll, the at least one belt and the material web being guided over at least a portion of the suction roll; and the at least one applicator being positioned in a vicinity of a suction region of the suction roll.

38. The wet section according to claim 30, the material web, at the time of application of the coating medium, having a solids content between approximately 3 and 50% by weight.

39. The wet section according to claim 30, the material web, at the time of application of the coating medium, having a solids content between approximately 3 and 23% by weight.

40. The wet section according to claim 30, the material web, at the time of application of the coating medium, having a solids content between approximately 3 and 17% by weight.

41. The wet section according to claim 30, the material web comprising one of a paper and a cardboard web.

42. The wet section according to claim 30, further comprising a press section and a screen section.

* * * * *